US006319062B1

(12) United States Patent
Ma et al.

(10) Patent No.: US 6,319,062 B1
(45) Date of Patent: Nov. 20, 2001

(54) BOARD MOUNTED ELECTRICAL CONNECTOR

(75) Inventors: Xuedong Ma; Guang Xing Shi, both of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/749,130

(22) Filed: Dec. 26, 2000

(30) Foreign Application Priority Data

Oct. 26, 2000 (TW) ..... 89218643 U

(51) Int. Cl.[7] ..... H01R 13/648
(52) U.S. Cl. ..... 439/607; 439/490
(58) Field of Search ..... 439/488, 489, 439/490, 607, 676, 609, 344

(56) References Cited

U.S. PATENT DOCUMENTS 6,217,371 * 4/2001 Wu ..... 439/676
6,227,911 * 5/2001 Boutoos et al. ..... 439/490

* cited by examiner

*Primary Examiner*—Hien Vu
(74) *Attorney, Agent, or Firm*—Wei Te Chung

(57) ABSTRACT

An electrical connector (1) includes an insulative housing (10), a terminal insert (30) receiving a plurality of terminals (31) therein and a one-piece shield (20) including a first shield portion (21) and a second shield portion (22). A pair of protruding portions (142) outwardly projects from side walls (14) formed on the housing and a groove (144) is defined in one side edge thereof. A pair of support tabs (25), each defining a notch (24), are formed at two opposite sides of the first shield portion, the notches of the shield interlocking with the grooves of the housing to prevent the sides of the shield from springing outwardly and to arrest upward movement of the shield relative to the housing.

3 Claims, 6 Drawing Sheets

BOARD MOUNTED ELECTRICAL CONNECTOR

BACKGROUND OF THE INVENTION

1. Field of the Invention

The present invention generally relates to an electrical connector, and particularly to a low profile electrical connector for mounting in a cutout in an edge of a printed circuit board.

2. Description of the Related Art

To protect electrical connectors from Electro Magnetic Interference (EMI), a metal shield enclosing a housing is often provided. The housing and the metal shield must remain in fixed positions relative to each other, particularly in environments subject to vibration. The metal shield is often constructed in two halves with a cooperating latching system being formed on both halves for securing each half together with the housing. A related electrical connector having a shield as described is shown in FIGS. 5 and 6. The shield includes a first shield 62 and a second shield 63. More manufacturing steps and cost and greater coordination during assembly are required for such two-part shields, as opposed to a single piece shield. Additionally, an engagement between an opening 64 defined in the first shield 62 and a protrusion 65 formed on a housing 61 can not prevent the first shield 62 from being vertically displaced relative to the housing 61.

Hence, an improved electrical connector is required to overcome the abovementioned problems.

BRIEF SUMMARY OF THE INVENTION

Accordingly, an objective of the present invention is to provide an electrical connector with a one-piece shield which encloses a housing and shields the housing from EMI and which can not be displaced relative to the housing in a perpendicular direction.

A further objective of the present invention is to provide an electrical connector which is easy to manufacture and assemble.

To fulfill the above-mentioned objectives, a board mounted electrical connector in accordance with the present invention comprises an insulative housing, a one-piece shield, a terminal insert retaining a plurality of terminals therein and a pair of light emitting diodes (LEDs). The insulative housing is substantially rectangular and defines a receiving space for receiving the terminal insert and a mating connector therein. The one-piece shield comprises a first shield portion and a second shield portion extending from a rear edge of the first shield portion. A pair of protruding portions outwardly projects from side walls of the housing and a groove is defined in a front side edge of each protruding portion. A pair of support tabs, each defining a notch at a rear side thereof, are formed at opposite sides of the first shield portion for engaging with the protruding portions. Each support tab abuts against a lower edge of a corresponding protruding portion, and fits in the groove of the corresponding protruding portion, thereby preventing a vertical displacement of the shield and preventing the opposite sides of the first shield portion from springing outwardly.

Other objects, advantages and novel features of the invention will become more apparent from the following detailed description when taken in conjunction with the accompanying drawings.

DESCRIPTION OF THE PREFERRED EMBODIMENT

Figure 1:
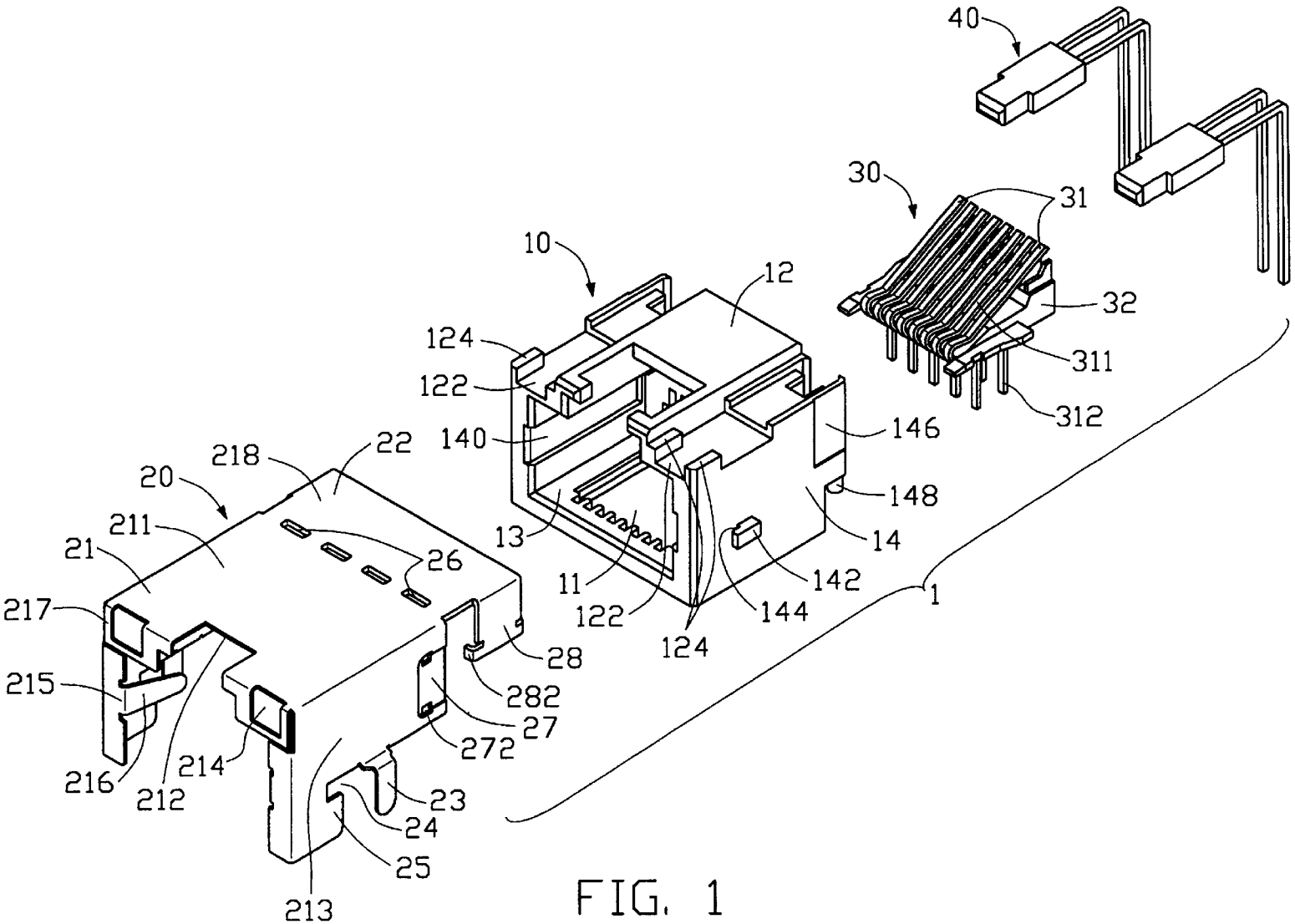
FIG. 1 is an exploded view of an electrical connector in accordance with the present invention.

Referring to FIG. 1, a board-mounted electrical connector 1 in accordance with the present invention comprises an insulative housing 10, a conductive one-piece shield 20, a terminal insert 30 with a plurality of terminals 31 therein and a pair of LEDs 40.

Figure 4:
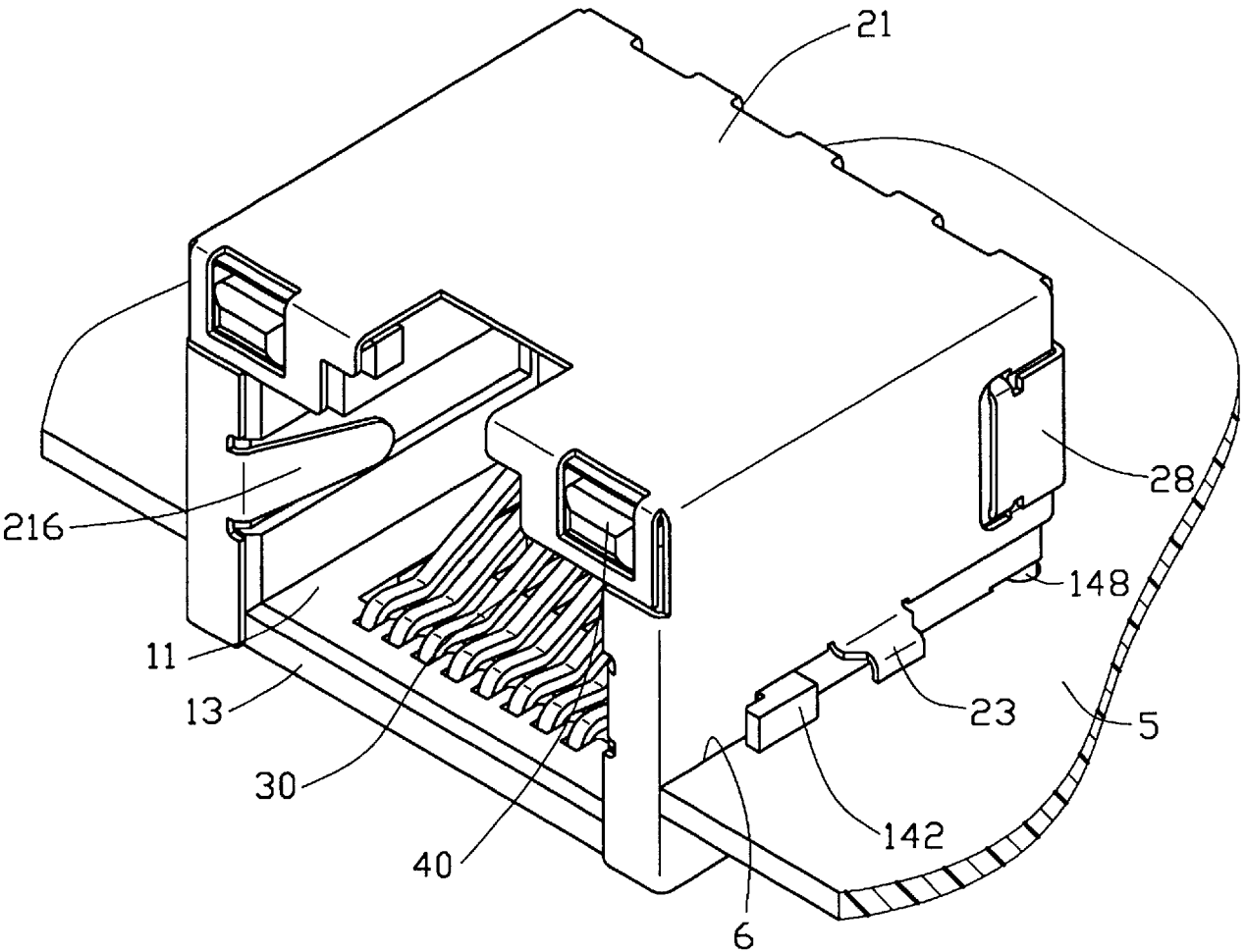
FIG. 4 is an assembled view of FIG. 1, wherein the electrical connector is mounted in a cutout of a circuit board.
Figure 5:
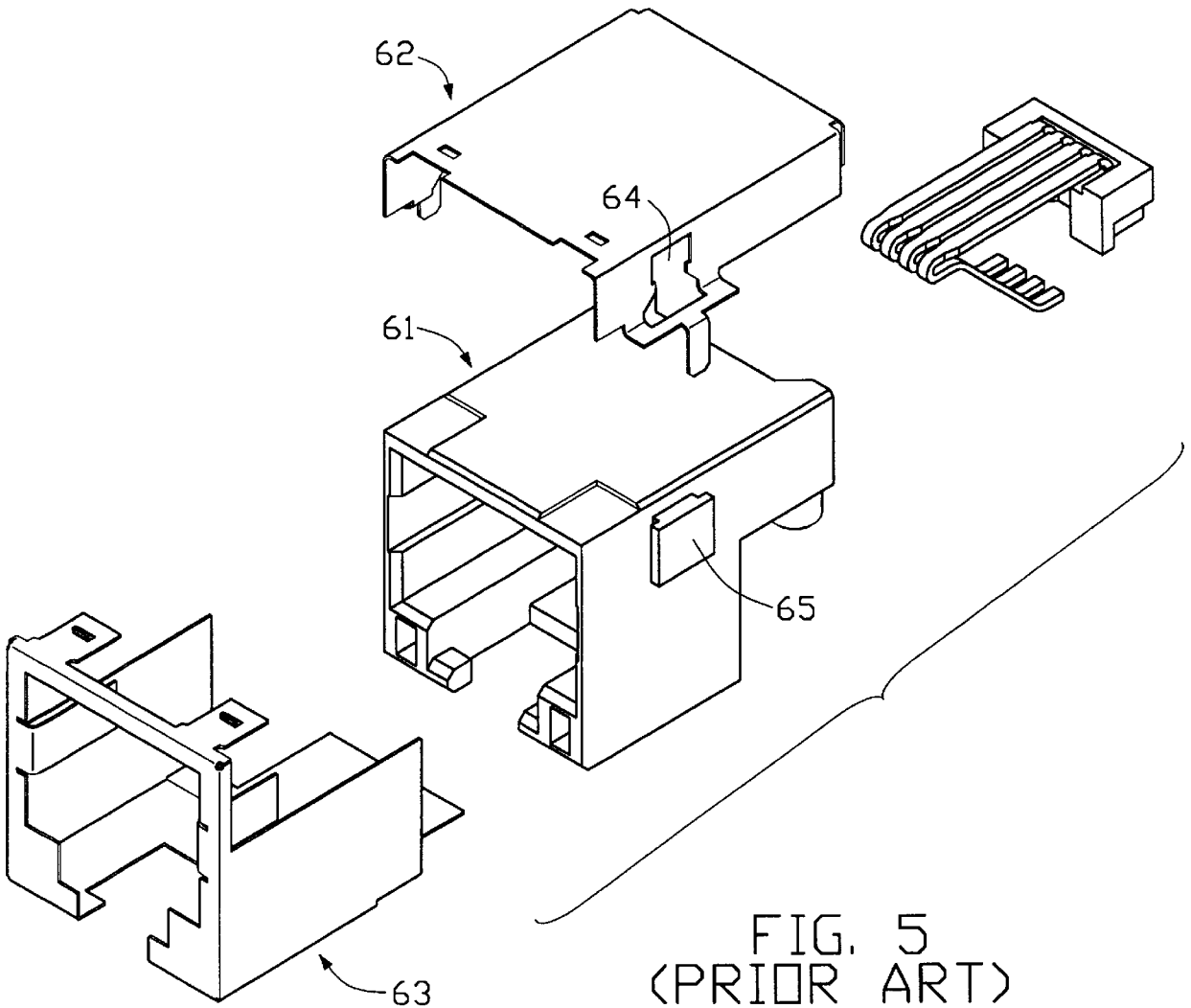
FIG. 5 (PRIOR ART)
FIG. 5 is an exploded view of a conventional connector.
Figure 6:
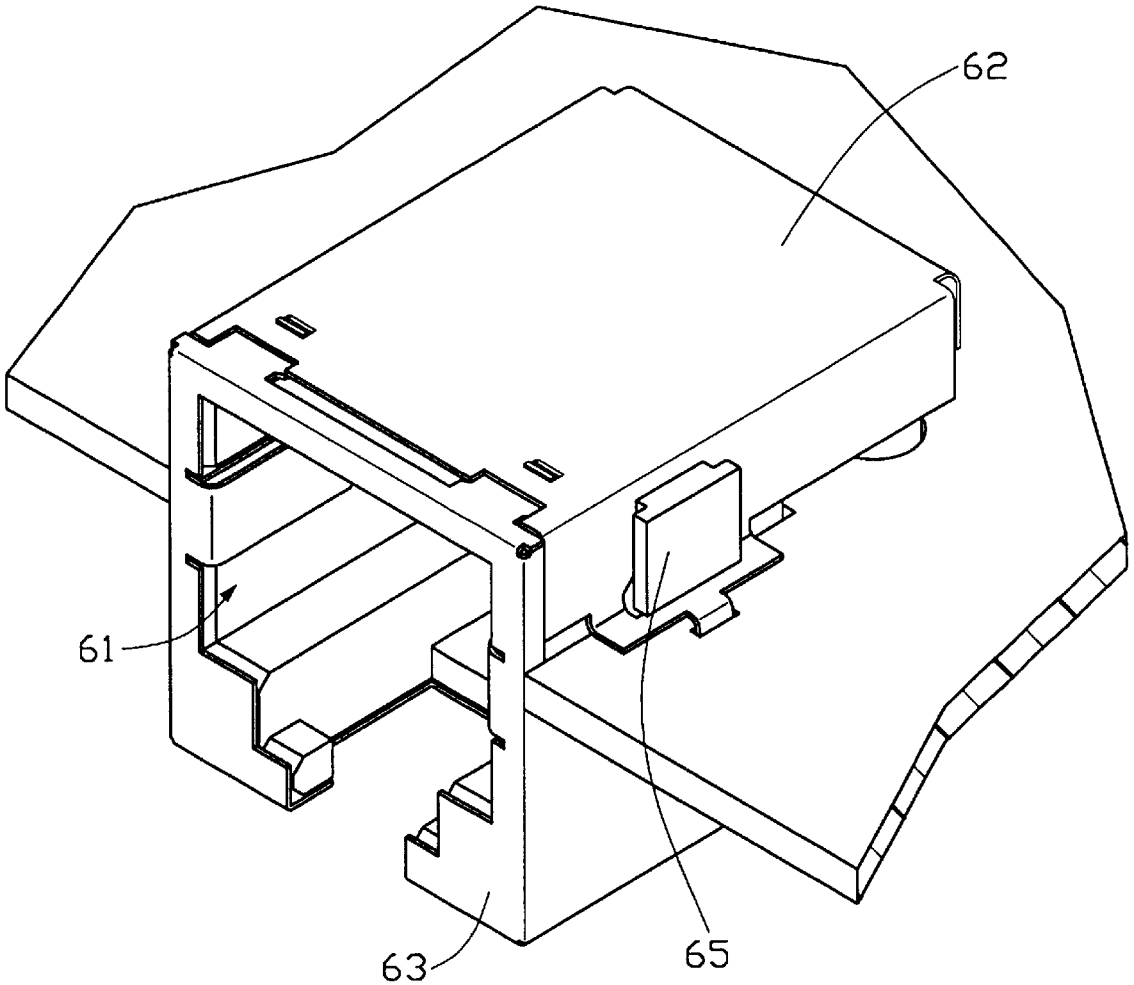
FIG. 6 (PRIOR ART)
FIG. 6 is an assembled view of FIG. 5, wherein the conventional connector is mounted in a cutout of a circuit board.

The insulative housing 10 is substantially rectangular and comprises a top wall 12, a bottom wall 13 and a pair of side walls 14 defining a receiving space 11 therebetween for receiving a mating connector (i.e., the plug jack not shown) therein. A pair of slots 122 is defined in opposite edges of the top wall 12 from a front to a rear of the housing 10 for detachably receiving the pair of LEDs 40. Two pairs of protrusions 124 are respectively formed at opposite sides of and at a front of each slot 122 for securing the LEDs 40 therebetween. A pair of protruding portions 142 outwardly extend from each side wall 14 and a groove 144 is disposed in a front side of each protruding portion 142. Each side wall 14 further defines a recess 146 at a rear thereof and forms a post 148 at a lower edge of the rear for locating the electrical connector 1 on a printed circuit board 5 (FIG. 4). An elongate recess 140 is defined inside each side wall 14, each recess 140 communicating with the receiving space 11.

Figure 2:
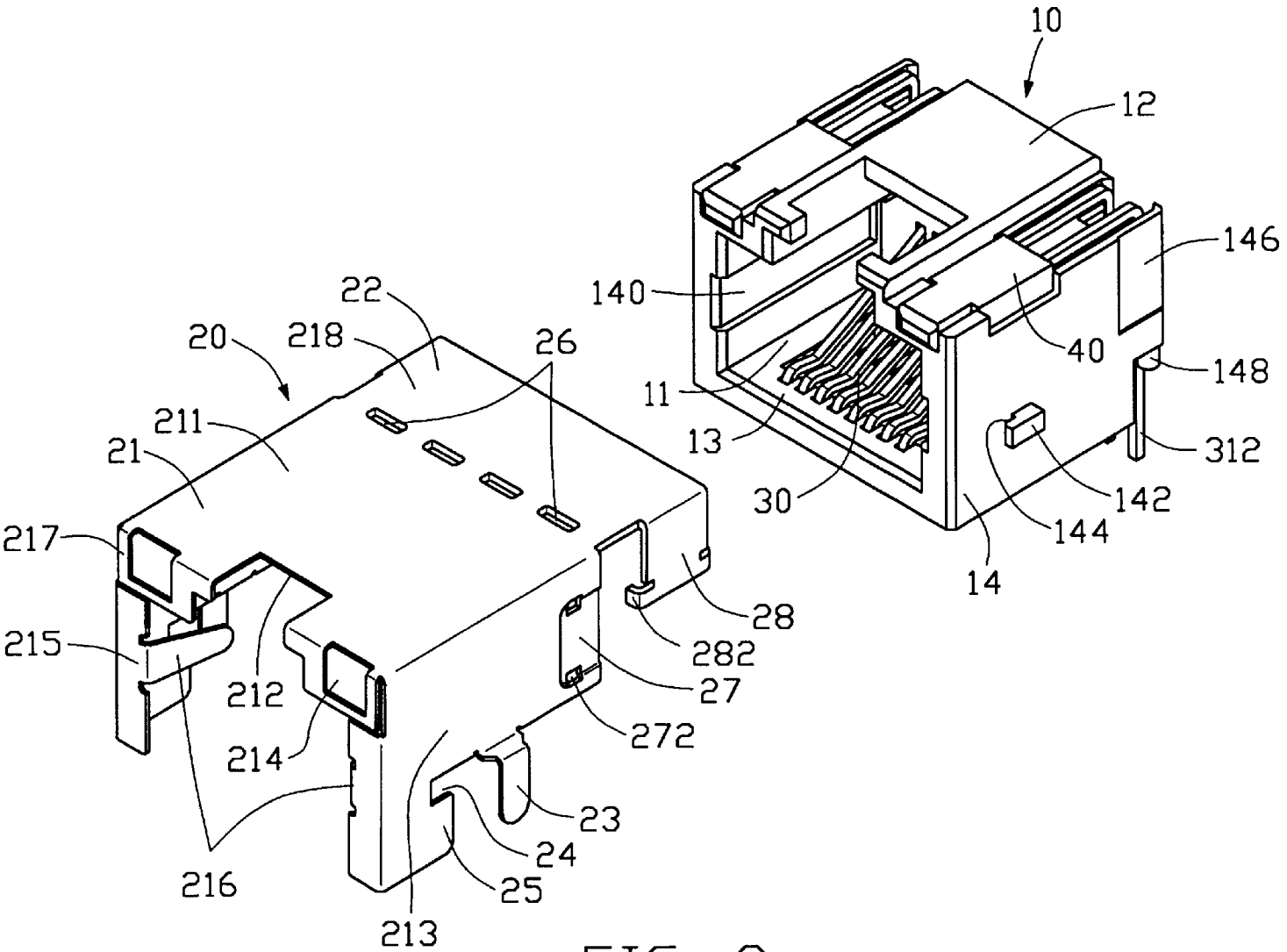
FIG. 2 is a partially assembled view of FIG. 1.

Referring to FIGS. 1 and 2, the terminal insert 30 is insertable into the insulative housing 10 and comprises a plurality of terminals 31 received in an insulative holder 32 thereof. Each terminal 31 includes a contact portion 311 extending above the holder 32 and a solder tail 312 extending through a bottom of the holder 32 for soldering to the printed circuit board 5 using through hole mounting technology. When the terminal insert 30 is assembled into the insulative housing 10, the contact portions 311 are received in the receiving space 11.

The shield 20 of the electrical connector 1 is stamped from one piece of metal sheet and comprises a first shield portion 21 and a second shield portion 22 extending from a rear edge of the first shield portion 21. A plurality of holes 26 is defined between the first and second shield portions 21, 22. The first shield portion 21 forms a top panel 211, two side panels 213 depending downwardly from opposite side edges of the top panel 211, two front panels 215 bending perpendicularly toward each other from front edges of the side panels 213, and a pair of front flaps 217 downwardly depending from a front edge of the top panel 211. The first shield portion 21 defines a cutout 212 in the front edge of the top panel 211 and a pair of rectangular holes 214 in the two front flaps 217. A pair of resilient pads 216 inwardly extends from facing edges of opposite front panels 215 beneath the rectangular holes 214. The second shield portion 22 forms a rear panel 218 and two side portions 28 perpendicularly extending from opposite side edges of the rear panel 218. Each side portion 28 forms a pair of rectangular tabs 282 inwardly projecting from opposite edges thereof. A pair of depressions 27 is defined adjacent rear edges of the side panels 213 corresponding to the side portions 28. Each depression 27 defines a pair of holes 272 therein for retaining the tabs 282 of a corresponding side portion 28. A pair of grounding pads 23 outwardly and then downwardly extends from lower edges of the side panels 213 of the first shield portion 21 for anchoring the connector 1 and for grounding the shield 20. A pair of support tabs 25 depend from forward lower edges of the side panels 213 of the first shield portion 21 in front of the grounding pads 23. A notch 24 is defined in a rear side of each support tab 25.

Figure 3:
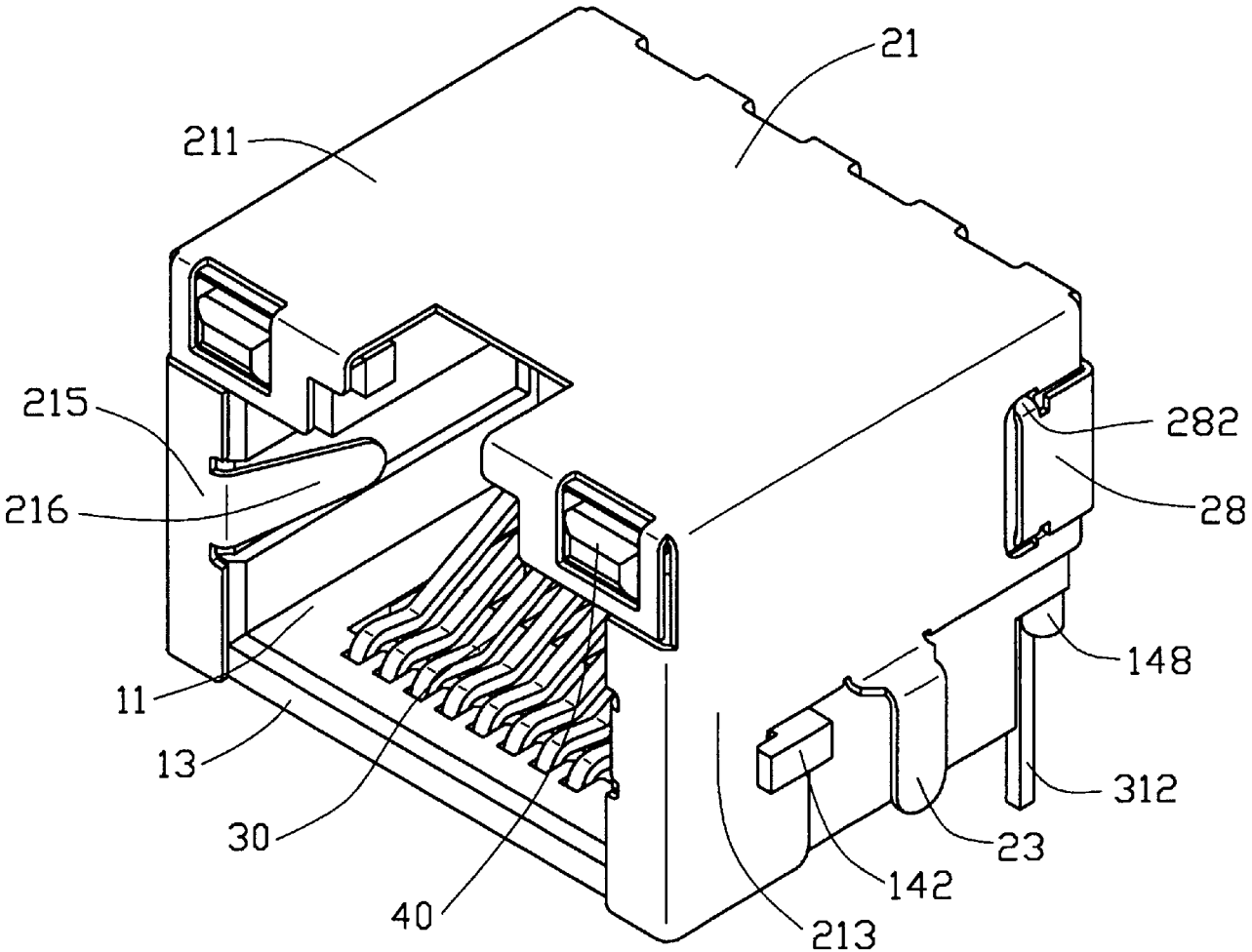
FIG. 3 is an assembled view of FIG. 1.

Referring to FIG. 3, in assembly, the terminal insert 30 is accommodated into the receiving space 11 from a rear side of the housing 10 to electrically engage with the mating connector. The pair of LEDs 40 are fixed in the slots 122 in the top wall 12 of the housing 10 with pairs of protrusions 124 securing the diodes 40 therebetween. The shield 20 attaches to the housing 10 with the second shield portion 22 being bent downwards to cover the rear of the housing 10. The depressions 27 of the shield 20 fit into the recesses 146 of the side walls 14 of the housing 10. The side portions 28 are fit into the depressions 27 with the pairs of tabs 282 extending into corresponding holes 272, thereby securing the rear panel 218 of the second shield portion 22 to the side panels 213 of the first shield portion 21. Each protruding portion 142 of the housing 10 engages with a corresponding support tab 25 with a rear edge of the support tab 25 at the notch 24 fitting in the groove 144 of the protruding portion 142 thereby securing the shield 20 on the housing 10 and preventing the side panels 213 of the shield 20 from springing outwardly. Each support tab 25 of the first shield portion 21 further abuts a lower edge of the corresponding protruding portion 142, thereby preventing upward movement of the shield 20 relative to the housing 10. The pair of resilient pads 216 is correspondingly received in the elongate recesses 140 of the housing 10 and fronts of the pair of LEDs 40 are exposed from the rectangular holes 214 of the shield 20.

When the connector 1 is assembled to the printed circuit board 5, referring to FIG. 4, a bottom portion (not labeled) of the housing 10 fits within a cutout 6 of the printed circuit board 5. A bottom side of each protruding portion 142 of the housing 10 abuts an upper surface of the printed circuit board 5 for supporting the electrical connector 1 thereon. Each grounding pad 23 of the shield 20 extends through a corresponding hole (not labeled) of the printed circuit board 5 for soldering thereto. The pair of posts 148 of the housing 10 extend through holes defined in the printed circuit board 5 for positioning the connector 1 thereon.

The shield 20 is in one piece, reducing manufacturing costs and easing coordination of parts during assembly. The shield 20 is firmly fixed to the housing 10 and the shield 20 and the housing 10 are firmly fixed to the printed circuit board 5, reducing relative movement therebetween and providing a solution to the shortcomings of the prior art.

It is to be understood, however, that even though numerous characteristics and advantages of the present invention have beenset forth in the foregoing description, together with details of the structure and function of the invention, the disclosure is illustrative only, and changes may be made in detail, especially in matter of shape, size, and arrangement of parts within the principles of the invention to the full extent indicated by the broad general meaning of the terms in which the appended claims are expressed.

What is claimed is:

1. An electrical connector comprising:

an insulative housing having a top wall, a bottom wall and a pair of side walls defining a receiving space therebetween adapted for receiving a mating connector therein, a pair of protruding portions outwardly projecting from the side walls and a groove defmed in one side of each protruding portion;

a pair of slots formed above said receiving space for detachably receiving a pair of LEDs therein;

a one-piece shield enclosing the housing, said shield including a front shield portion and a rear shielding portion integrally formed with said front shield portion, said front shield portion including a top panel, two side panels downwardly depending from two opposite side edges of said top panel, two front panels bending perpendicularly toward each other from front edges of the side panels, respectively, a pair of support tabs formed at lower edges of opposite side panels of the front shield portion to fit into the grooves of the protruding portions on the housing thereby fixing the side panels to the housing in a direction normal to the side walls of the housing; and a pair of front flaps downwardly extending from a front edge of said top panel; wherein a cutout is defined around said front edge of said top panel between said pair of front flaps, and each of said front flaps defines an opening therein in alignment with the corresponding LED to expose said LED to an exterior; wherein a notch is defined in each support tab and the support tab interlocks at the notch with the protruding portion at the groove so that the support tab abuts a bottom side of the protruding portion of the housing thereby arresting upward movement of the side panels relative to the housing, as well as arresting outward movement of the side panels along a direction normal to the side walls of the housing; wherein the rear shield portion forms two side portions extending from opposite sides thereof and a pair of rectangular tabs projecting perpendicularly from each side portion at upper and lower edges of the side portions.

2. The connector as claimed in claim 1, wherein a pair of resilient pads extend rearwardly from facing edges of the corresponding front panels, respectively.

3. The electrical connector as claimed in claim 1, wherein each side panel of the first shield portion defines a depression at a rear thereof and a pair of holes is defined through each side panel in the corresponding depression, and the side portions of the second shield portion fit into corresponding depressions of the first shield portion, and the rectangular tabs of the side portions are retained in the holes of corresponding depressions.

* * * * *